US011781390B2

(12) United States Patent
Gao et al.

(10) Patent No.: US 11,781,390 B2
(45) **Date of Patent: *Oct. 10, 2023**

(54) FIDELITY RETAINING TYPE CORING DEVICE FOR ROCK SAMPLE

(71) Applicant: SHENZHEN UNIVERSITY, Guangdong (CN)

(72) Inventors: Mingzhong Gao, Guangdong (CN); Heping Xie, Guangdong (CN); Ling Chen, Guangdong (CN); Jianbo Zhu, Guangdong (CN); Cunbao Li, Guangdong (CN); Zhiyi Liao, Guangdong (CN); Zhiqiang He, Guangdong (CN); Jun Guo, Guangdong (CN); Cong Li, Guangdong (CN)

(73) Assignee: SHENZHEN UNIVERSITY, Guangdong (CN)

( * ) Notice: Subject to any disclaimer, the term of this patent is extended or adjusted under 35 U.S.C. 154(b) by 228 days.

This patent is subject to a terminal disclaimer.

(21) Appl. No.: 17/419,028

(22) PCT Filed: Mar. 15, 2019

(86) PCT No.: PCT/CN2019/078276

§ 371 (c)(1),
(2) Date: Feb. 3, 2022

(87) PCT Pub. No.: WO2020/133724

PCT Pub. Date: Jul. 2, 2020

(65) Prior Publication Data

US 2022/0186576 A1 Jun. 16, 2022

(30) Foreign Application Priority Data

Dec. 26, 2018 (CN) ..... 201811596457.8

(51) Int. Cl.
*E21B 25/10* (2006.01)
*E21B 10/02* (2006.01)
*E21B 10/60* (2006.01)

(52) U.S. Cl.
CPC ..... *E21B 25/10* (2013.01); *E21B 10/02* (2013.01); *E21B 10/605* (2013.01); *E21B 2200/05* (2020.05)

(58) Field of Classification Search
CPC ..... E21B 10/02; E21B 10/605; E21B 25/08; E21B 25/10; E21B 2200/05; E21B 10/26; E21B 10/44; E21B 34/06
See application file for complete search history.

(56) References Cited

U.S. PATENT DOCUMENTS 4,071,099 A * 1/1978 Hensel, Jr. ..... E21B 25/005 73/864.91
4,716,974 A * 1/1988 Radford ..... E21B 25/08 175/59

(Continued)

FOREIGN PATENT DOCUMENTS

| | | | |
|---|---|---|---|
| CN | 200958379 Y | | 10/2007 |
| CN | 101215959 A | * | 7/2008 |
| CN | 106932223 A | * | 7/2017 |
| CN | 106988697 A | | 7/2017 |
| CN | 108266147 A | | 7/2018 |
| WO | 2010045691 A1 | | 4/2010 |

*Primary Examiner* — Taras P Bemko
(74) *Attorney, Agent, or Firm* — NKL Law; Allen Xue

(57) ABSTRACT

A fidelity retaining type coring device for a rock sample, comprising a rock core drilling tool, a rock core sample storage barrel, and a rock core sample fidelity retaining cabin. The rock core drilling tool comprises a coring drilling tool, a core catcher (11), and an inner core pipe (12); the coring drilling tool comprises an outer core pipe (13) and a hollow drill bit (14), and the drill bit (14) is connected to the lower end of the outer core pipe (13); the lower end of the inner core pipe (12) extends to the bottom of the outer core pipe (13), and the inner core pipe (12) is in clearance fit with the outer core pipe (13); the rock core sample fidelity (Continued)

retaining cabin comprises an inner coring barrel (28), an outer coring barrel (26), and an energy accumulator (229); the outer coring barrel (26) is sleeved on the inner coring barrel (28); the upper end of the inner coring barrel (28) is communicated with a liquid nitrogen storage tank (225), and the liquid nitrogen storage tank (225) is located in the outer coring barrel (26); the energy accumulator (229) is communicated with the outer coring barrel (26); the outer coring barrel (26) is provided with a flap valve (23). According to the device, a rock core can maintain its state in an in-situ environment; in addition, the drilling speed can be increased, and the coring efficiency can be improved.

10 Claims, 13 Drawing Sheets

(56) References Cited

U.S. PATENT DOCUMENTS

| | | | | |
|---|---|---|---|---|
| 5,301,759 | A | 4/1994 | Ruhle | |
| 6,283,228 | B2 * | 9/2001 | Collee | E21B 25/08 175/58 |
| 8,307,704 | B2 * | 11/2012 | Georgi | G01V 9/00 73/152.07 |
| 9,828,820 | B2 * | 11/2017 | Gupta | G01V 5/04 |

* cited by examiner

FIDELITY RETAINING TYPE CORING DEVICE FOR ROCK SAMPLE

TECHNICAL FIELD

The present invention relates to the field of oil and gas field exploration, and in particular to a fidelity-retaining coring device for rock sample.

BACKGROUND ART

In the process of oilfield exploration, rock core is the key material for discovering oil and gas reservoir, as well as studying stratum, source rock, reservoir rock, cap rock, structure, and so on. Through the observation and study of the core, the lithology, physical properties, as well as the occurrence and characteristics of oil, gas, and water can be directly understood. After the oilfield is put into development, it is necessary to further study and understand the reservoir sedimentary characteristics, reservoir physical properties, pore structure, wettability, relative permeability, lithofacies characteristics, reservoir physical simulation, and reservoir water flooding law through core. Understanding and mastering the water flooded characteristics of reservoirs in different development stages and water cut stages, and finding out the distribution of remaining oil can provide scientific basis for the design of oilfield development plan, formation system, well pattern adjustment, and infill well.

Coring is to use special coring tools to take underground rocks to the ground in the process of drilling, and this kind of rock is called core. Through it, various properties of rocks can be determined, underground structure and sedimentary environment can be studied intuitively, and fluid properties can be understood, etc. In the process of mineral exploration and development, the drilling work can be carried out according to the geological design of strata and depth, and coring tools were put into the well, to drill out core samples and store in the core storage chamber. In the process of equipment rise, the temperature, pressure and other environmental parameters of core storage chamber will be reduced, so that the core can not maintain its state of in-situ conditions.

The coring tool comprises a coring drilling tool and a core catcher. After the coring drilling tool is cut into the stratum, a core catcher makes the core keep in the inner barrel. The core catcher in the prior art can only take soft rock, by which it is difficult to take hard rock. In addition, the coring drilling tool has a slow blade-cooling speed, fast tool wear, and a short service life.

CONTENT OF THE INVENTION

The present invention aims to provide a fidelity-retaining coring device for rock sample, which is beneficial for maintaining the in situ conditions of the core, and can improve the drilling speed and the coring efficiency.

To achieve the above objective, the present invention is realized by the following technical solutions: A fidelity-retaining coring device for a rock sample disclosed in the present invention comprises a rock core drilling tool, a rock core sample storage barrel, and a rock core sample fidelity-retaining cabin. The rock core drilling tool comprises a coring drilling tool, a core catcher, and an inner core pipe; the coring drilling tool comprises an outer core pipe and a hollow drill bit, and the drill bit is connected to the lower end of the outer core pipe; the core catcher comprises an annular base and a plurality of claws, in which the annular base is coaxially mounted on the inner wall of the lower end of the inner core pipe, and the claws are uniformly arranged on the annular base. The lower end of the claws is connected with the annular base, and the upper end of the claws is closed inward; the lower end of the inner core pipe extends to the bottom of the outer core pipe, and the inner core pipe is in clearance fit with the outer core pipe;

said core sample storage barrel comprises a rock core barrel, a drilling machine outer cylinder, a flap valve and a trigger mechanism. The flap valve comprises a valve seat and a sealing flap, the valve seat is coaxially mounted on the inner wall of the drilling machine outer cylinder, and one end of the sealing flap is movably connected to the outer sidewall of the upper end of the valve seat; the top of the valve seat is provided with a valve port sealing surface matched with the sealing flap. The rock core sample fidelity-retaining cabin comprises an inner coring barrel, an outer coring barrel, and an energy accumulator. The outer coring barrel is sleeved on the inner coring barrel; the upper end of the inner coring barrel is communicated with a liquid nitrogen storage tank, and the liquid nitrogen storage tank is located in the outer coring barrel; the energy accumulator is communicated with the outer coring barrel; the outer coring barrel is provided with a flap valve.

Further, said rock core sample fidelity-retaining cabin further comprises an electric heater, a temperature sensor, an electric control valve arranged between the inner coring barrel and the liquid nitrogen storage tank, a pressure sensor, and a three-way stop valve arranged between the energy accumulator and the outer coring barrel. The two ways of the three-way stop valve are respectively connected with the energy accumulator and the outer coring barrel, while the third way of the three-way stop valve A is connected with a pressure relief valve, and the stop valve is an electrically controlled valve. The temperature sensor and the pressure sensor are connected to the processing unit, and the electric heater, the electric control valve and the three-way stop valve are all controlled by the processing unit. The electric heater is used to heat the inside of the outer coring barrel, the temperature sensor is used to detect the temperature in the fidelity-retaining chamber, and the pressure sensor is used to detect the pressure in the fidelity chamber.

Preferably, the drill bit includes a first-stage blade for drilling and a second-stage blade for reaming. The drill bit comprises an inner drill bit and an outer drill bit. The inner drill bit is installed in the outer drill bit, and the first-stage blade (82) is located at the lower end of the inner drill bit, while the secondary blade is located on the outer sidewall of the outer drill bit. The first-stage blades are provided with three at equal intervals in the circumferential direction, and the second-stage blades are also provided with three at equal intervals in the circumferential direction, and both the first-stage blades and the second-stage blades on the drill bit are provided with coolant circuit holes.

Preferably, the outer core pipe and the outer wall of the drill bit are both provided with a spiral groove, and the spiral groove on the drill bit is continuous with that on the outer core tube.

Preferably, the claw comprises a vertical arm and a tilt arm which are integrally manufactured. The lower end of the vertical arm is connected with the annular base, while the upper end of the vertical arm is connected with the lower end of the tilt arm. The upper end of the tilt arm is a free end, and the tilt arm tilts inward from bottom to top, with a tilt angle of 60°.

Preferably, the sealing valve flap includes an elastic sealing ring, elastic connecting strips, sealings, and a plurality of locking strips arranged in parallel; the elastic connecting strip connects all the locking strips in series, and the elastic sealing ring loops all the locking strips together, to form an integral structure. The locking strip is provided with a groove adapted to the elastic sealing ring, and the elastic sealing ring is installed in the groove. There is a sealing between two adjacent locking strips. One end of the valve flap is movably connected to the upper end of the valve seat through a limit hinge; the valve flap is curved when it is not turned down, and the valve flap is attached to the outer wall of the inner coring barrel; the valve flap is flat when it is turned down and covers the upper end of the valve seat.

Further, the inner wall of the outer coring barrel is provided with a sealing cavity, and the flap plate is located in the sealing cavity. The sealing cavity is in communication with the inner coring barrel. The inner wall of the outer coring barrel is provided with a sealing ring, which is located below the flap valve.

Further, the electric heater is a resistance wire, which is embedded in the inner wall of the outer coring barrel, and coated with an insulating layer.

Further, a graphene layer is covered on the inner wall of the inner coring barrel.

Further, the upper part of the inner coring barrel is filled with a drip film-forming agent.

The present invention has the following beneficial effects:

1. In the present invention, the fidelity-retaining cabin can be automatically heated and cooled, which is beneficial for the core to maintain its in situ conditions.
2. In the present invention, the fidelity-retaining cabin can be automatically pressured, which is beneficial for the core to maintain its in situ conditions.
3. The flap mechanism of the present invention can automatically close the fidelity-retaining cabin when the coring is completed, and has a simple structure, safety and reliability.
4. The graphene layer of the present invention can reduce the sliding resistance of the core on the inner side of the PVC pipe, improve the strength and surface accuracy of the inner side, and enhance the thermal conductivity coefficient and the like.
5. The sealing cavity of the present invention can isolate the drilling fluid passing through the fidelity-retaining cavity.
6. In the present invention, a mechanical claw that faces upwards and is folded inward is designed. When the claws go down, the claws are easily propped up by the core, so that the core enters the inner core barrel; when the claws go up, it is difficult for claws to be stretched by the rock core, and because the rock core cannot resist the greater pulling force and the clamping action of the claws, the rock core is broken at the claws, and the broken core will continue to move up with the claws and remain in the inner barrel;
7. In the present invention, the drill bit is divided into two-stage blades, the bottom blade drills a small hole first, and then the upper blade expands the hole, so as to improve the drilling speed and the coring efficiency;
8. In the present invention, a through hole is provided in the blade part as a coolant circuit hole, and the coolant can be sprayed out through the through hole to cool the blade, speed up the cooling rate of the blade, reduce the wear of the tool, and extend the life of the blade;
9. The outer wall of the outer core tube is provided with a spiral groove continuous with that of the drill bit, and as the outer core tube is screwed into the rock formation, the outer core tube creates a closed space for the coring tool, which can prevent the fidelity-retaining cabin from being contaminated.

EXAMPLES

Figure 1:
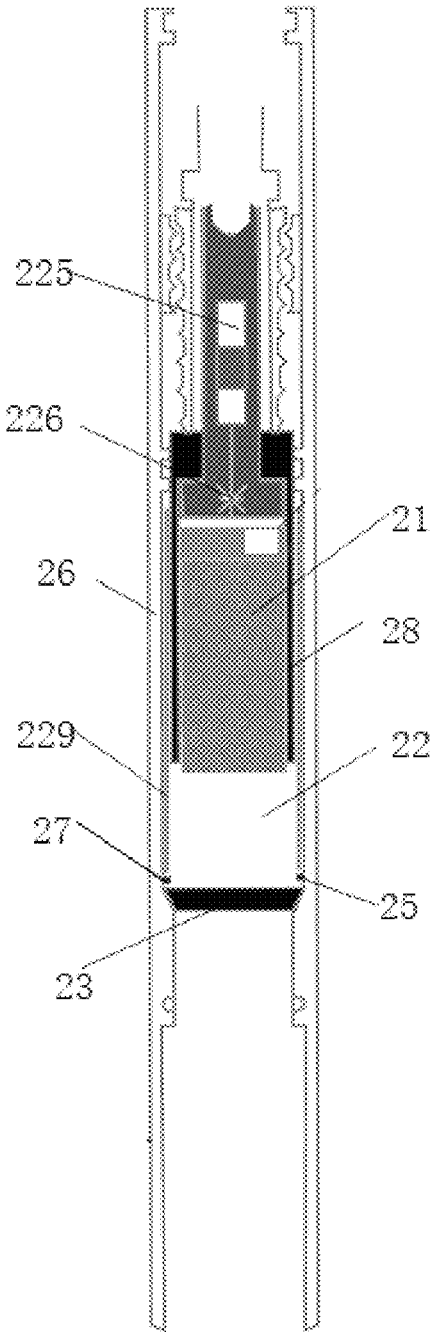
FIG. 1. The structural schematic diagram of the present invention.

In order to make the objectives, technical solutions, and advantages of the present invention clearer, the present invention will be further illustrated hereinafter by combing with the attached Figures. The fidelity-retaining coring device for a rock sample disclosed in the present invention comprises a rock core drilling tool, a rock core sample storage barrel, and a rock core sample fidelity-retaining cabin. As shown in FIG. 1, a rock core sample fidelity-retaining cabin comprises a mechanical part and a control part. The mechanical part includes an inner coring barrel 28, an outer coring barrel 26 and an energy accumulator 229. The energy accumulator 229 is connected to the outer coring barrel, and the inner coring barrel 28 is used to place the rock core 21, and the outer coring barrel 26 is sleeved on the inner coring barrel 28. The upper end of the inner coring barrel 28 is connected to the liquid nitrogen storage tank 225. An electric control valve 226 is arranged on the communication pipeline between the inner coring barrel 28 and the liquid nitrogen storage tank 225. The liquid nitrogen storage tank 225 is located in the outer coring barrel 26, and the outer coring barrel 26 is provided with a flap valve 23.

Figure 2:
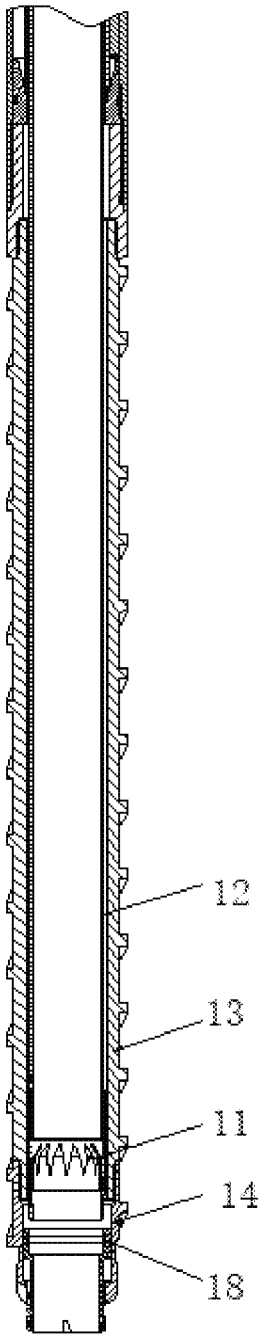
FIG. 2. The structural schematic diagram of the rock core drilling tool.
Figure 7:
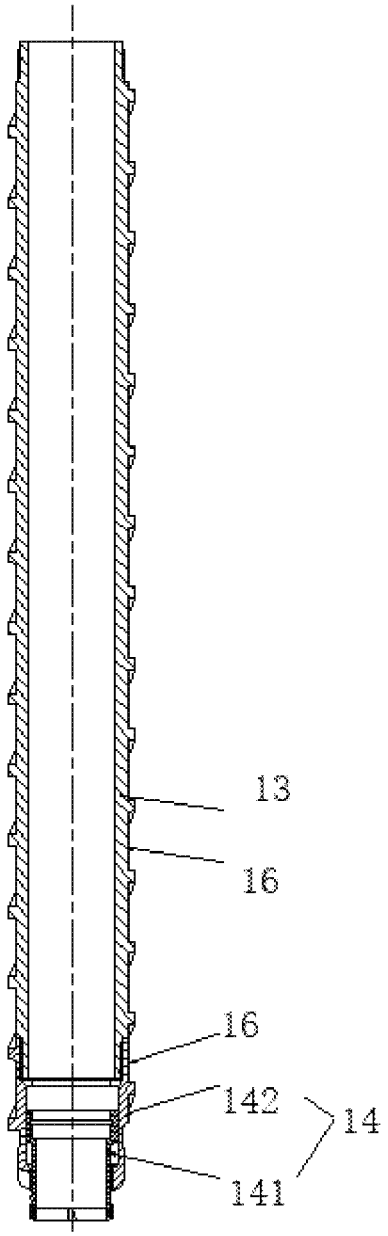
FIG. 7. The structural schematic diagram of the coring drilling tool.

As shown in FIGS. 2 and 7, the rock core drilling tool comprises a coring drilling tool, a core catcher 11, and an inner core pipe 12. The coring drilling tool comprises an outer core pipe 13 and a hollow drill bit 14, and the drill bit 14 is connected to the lower end of the outer core pipe 13. The core catcher is mounted on the inner wall of the lower end of the inner core pipe 12. The lower end of the inner core pipe 12 extends to the bottom of the outer core pipe 13 and is in clearance fit with the outer core pipe 13.

Figure 5:
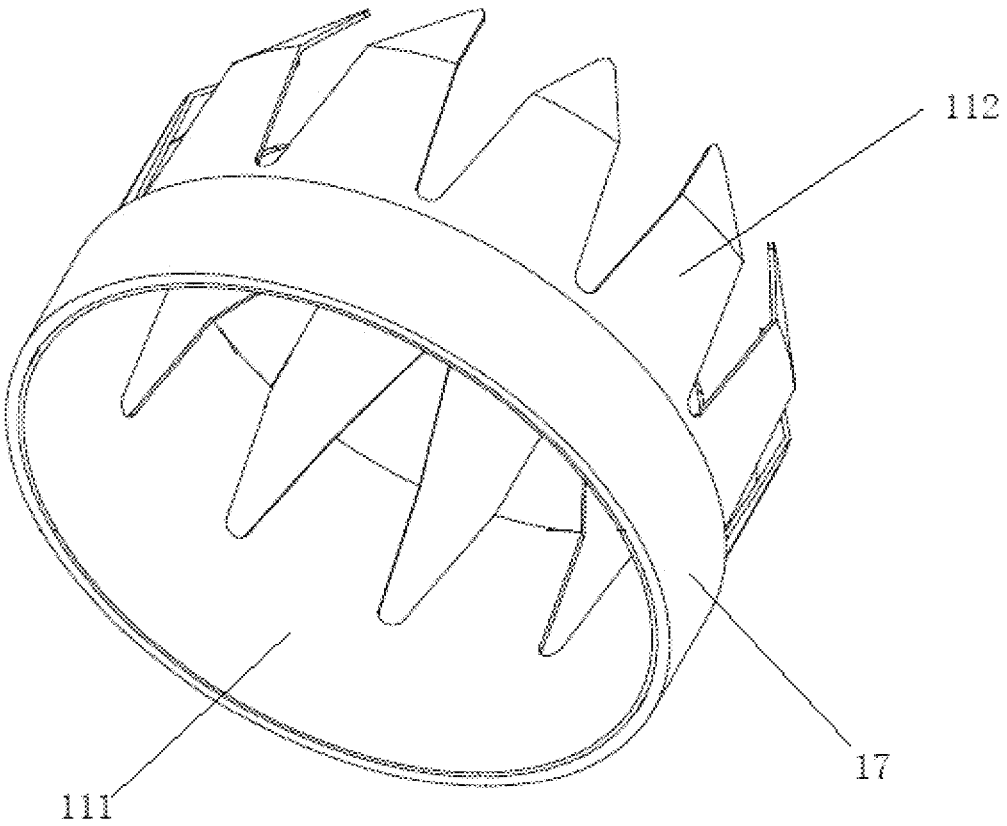
FIG. 5. 3D drawing of the core catcher.
Figure 6:
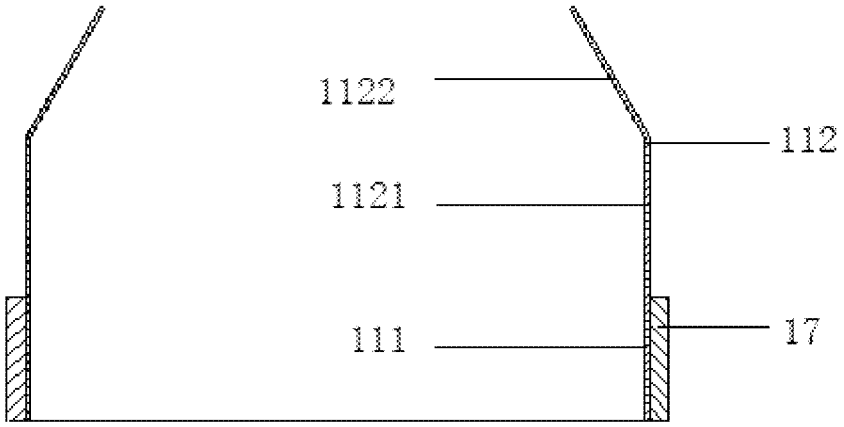
FIG. 6. Sectional view of the core catcher.

As shown in FIGS. 5 and 6, the core catcher 11 includes an annular base 111 and a plurality of claws 112. The claws 112 are evenly arranged on the annular base 111. The lower ends of the claws 112 are connected with the annular base 111, while the upper ends of the claws 112 are folded inward. There are 8~15 claws 112, preferably 12 claws 112. The number of claws 112 can be set as required, and is not limited to those listed above.

The claw 112 includes integrally manufactured vertical arm 1121 and tilt arm 1122. The lower end of the vertical arm 1121 is connected with the annular base 11, while the upper end of the vertical arm 1121 is connected with the lower end of the tilt arm 1122, and the upper end of the tilt arm 1122 is a free end. The tilt arm 1122 is inclined inward from bottom to top, and the inclination of the tilt arm 1122 can be adjusted as required. In this example, the tilt angle of the tilt arm 1122 is 60°, and the width of the claw 112 gradually decreases from bottom to top.

Figure 3:
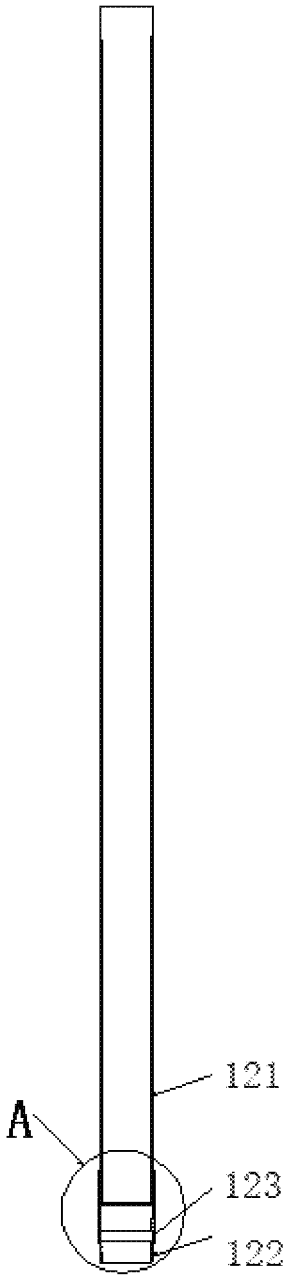
FIG. 3. The structural schematic diagram of the inner core pipe.
Figure 4:
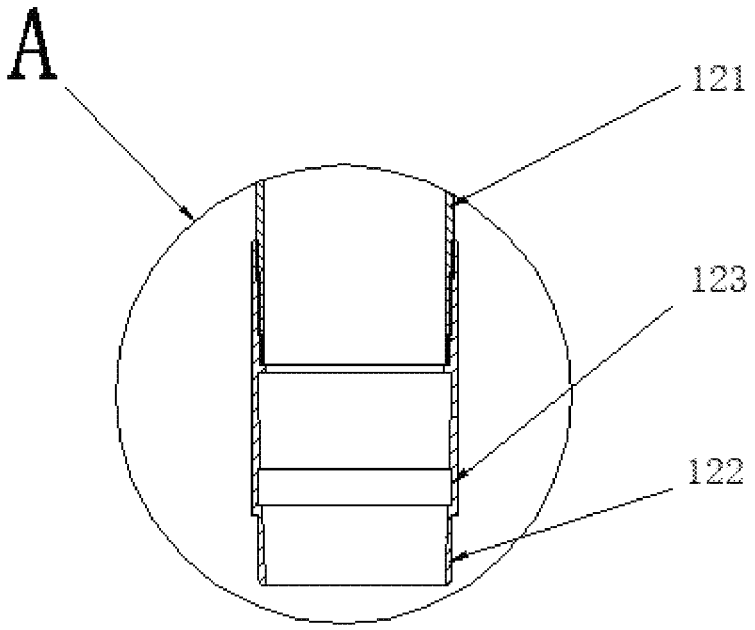
FIG. 4. An enlarged view of A in FIG. 3.

Wherein, the thickness of the claw 112 is equal to the thickness of the annular base 111, and the claw 112 is manufactured integrally with the annular base 111. The annular base 111 is sheathed with an annular sleeve 17, and both of annular base 111 and annular sleeve 17 are fixedly connected. The inner wall of the inner core pipe 12 is coated with graphene. As shown in FIGS. 3 and 4, the inner core pipe 12 comprises a core barrel 121 and a core casing 122. The upper end of the core casing 122 is fixed at the lower end of the core barrel 121. The inner wall of the core casing 122 is provided with an annular groove 123 adapted to the annular sleeve 17. The annular sleeve 17 is installed in the annular groove 123, and the free end of the claw 112 faces upward. The free end of the claw 112 faces upwards and inwards, and when the core passes through the hard core catcher 11 from bottom to top, the claw 112 are easily stretched, while it is difficult from top to bottom.

Figure 8:
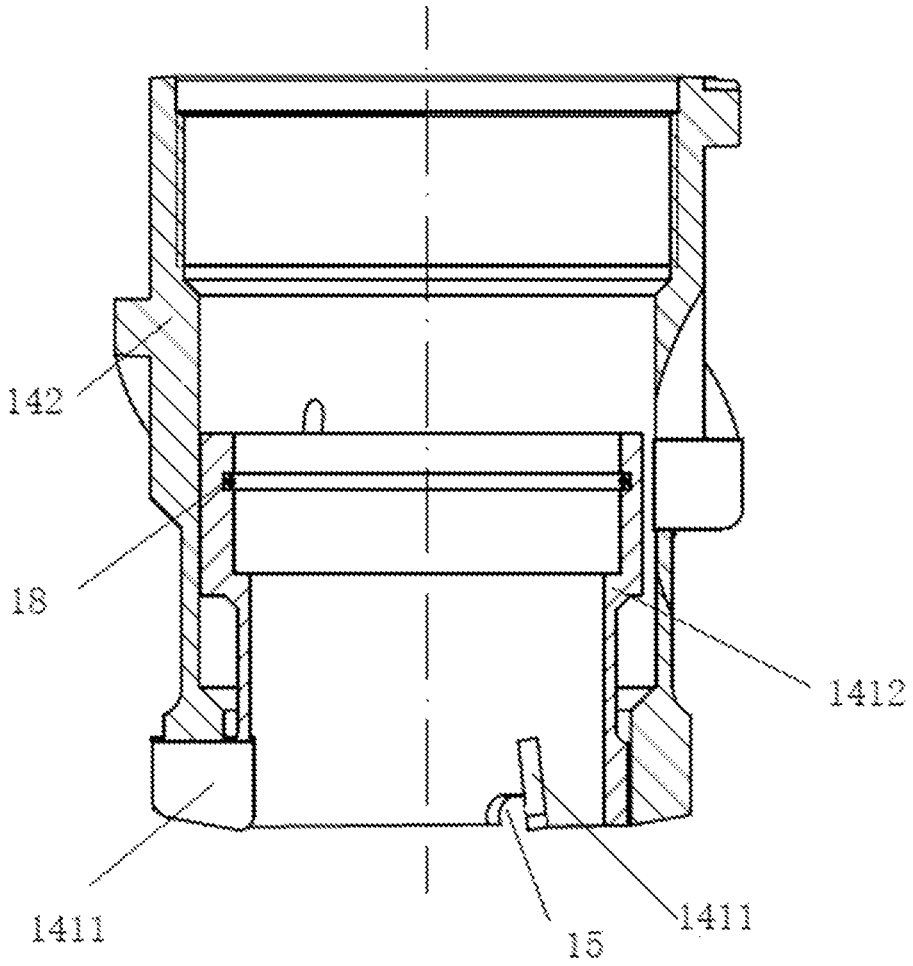
FIG. 8. The structural schematic diagram of the drill bit.
Figure 10:
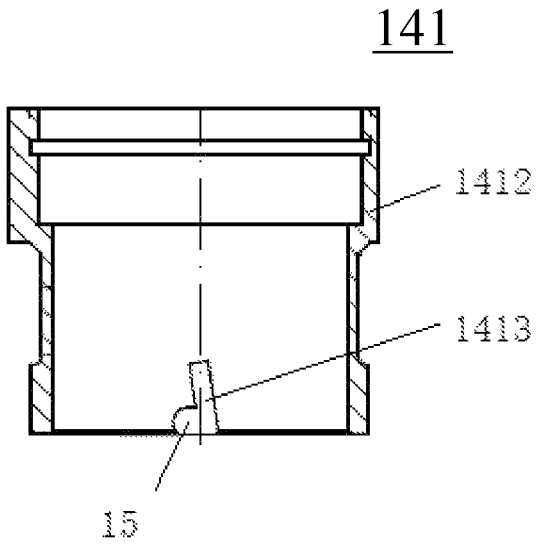
FIG. 10. The structural schematic diagram of the inner drilling cutter body.

The drill bit 14 is a PCD tool. As shown in FIGS. 7 and 8, the drill bit 14 comprises an inner drill bit 141 and an outer drill bit 142, and the inner drill bit 141 includes a first-stage blade 1411 and a hollow inner drill body 1412. As shown in FIG. 10, the lower end of the inner drill body 1412 is provided with a first-stage blade installation groove 1413 for installing the first-stage blade 1411. The first-stage blade installation groove 1413 is opened on the lower end surface of the inner drill body 1412, on which the first stage blade installation groove 1413 is provided with a coolant circuit hole 15, that is an arc-shaped hole. The arc-shaped hole opens on the front end surface of the drill bit 4 and communicates with the first-stage blade installation groove 1413. The inner drill body 1412 is provided with three first-stage blade mounting grooves 1413 at equal intervals in the circumferential direction. Each first-stage blade mounting groove 1413 is provided with a coolant circuit hole 15, and a first-stage blade 1411 is installed in each first-stage blade mounting groove 1413.

Figure 9:
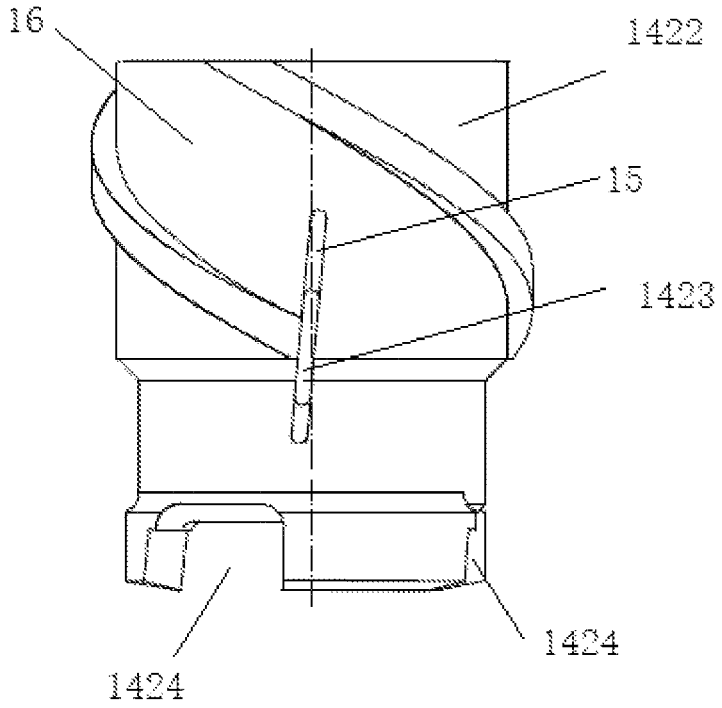
FIG. 9. The structural schematic diagram of the outer drilling cutter body.

The outer drill bit 142 comprises a second-stage blade 1421 and a hollow outer drill body 1422. As shown in FIG. 9, the outer wall of the second-stage blade 1421 is provided with a second-stage blade installation groove 1423 for installing the second-stage blade 1421, and the second-stage blade installation groove 1423 on the outer drill body 1422 is provided with a coolant circuit hole 15, which is a bar-shaped hole. The bar-shaped hole communicates with the second-stage blade installation groove 1423. The outer drill body 1422 is provided with three second-stage blade installation grooves 1423 at equal intervals in the circumferential direction, and each second-stage blade installation groove 1423 is provided with a coolant circuit hole 15, and each second-stage blade 1421 is installed in each second-stage blade installation groove 1423.

The inner drill bit 141 is installed inside the outer drill bit 142, and the outer drill body 1422 has a first-stage blade avoidance notch 1424 at a position corresponding to the first-stage blade 1411. The first-stage blade avoidance notch 1424 opens on the front end of the outer drill bit 142. The cutting edge of the first-stage blade 1411 is exposed from the outer drill body 1422 by the first-stage blade avoidance notch 1424.

The inner wall of the inner drill body 1412 is provided with a seal ring 18, and the seal ring 18 is located above the first-stage blade 1411. Using a highly elastic annular sealing ring, the rock core can be wrapped in the process of coring, so as to achieve the effect of isolation and quality assurance, as well as realize the objectives of moisturizing and guaranteeing the quality.

In the present invention, the drill bit is divided into two-stage blades. The first-stage blade 1411 at the lower end first drills a small hole, and then the second-stage blade 1421 at the upper reams the hole, which can increase the drilling speed. A through hole is provided at the blade position as a cooling liquid circuit hole 15, through which cooling liquid can be sprayed to cool the blade. The carbide sharp thin bit is used to cut the rock stratum, to reduce the disturbance of coring process to the formation and ensure the integrity and quality of coring.

As shown in FIGS. 2, 7, and 9, both the outer core tube 13 and the outer wall of the outer drill body 1422 are provided with spiral grooves 6, and the spiral groove 16 on the outer drill body 1422 is continuous with the spiral groove 16 on the outer core tube 13. The outer core tube 16 with the spiral groove 13 on the outer wall is equivalent to a spiral outer drill. As the outer core tube 13 is screwed into the rock formation, the outer core tube 13 creates a closed space for the coring tool. During the coring process, the sealing ring 18 wraps the core, to prevent contamination of the fidelity-retaining cabin.

Figure 11:
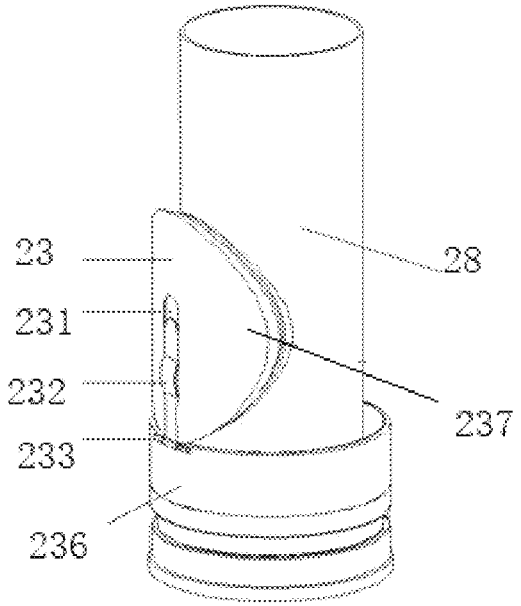
FIG. 11. The structural schematic diagram of the flap valve when it is not turned down.
Figure 12:
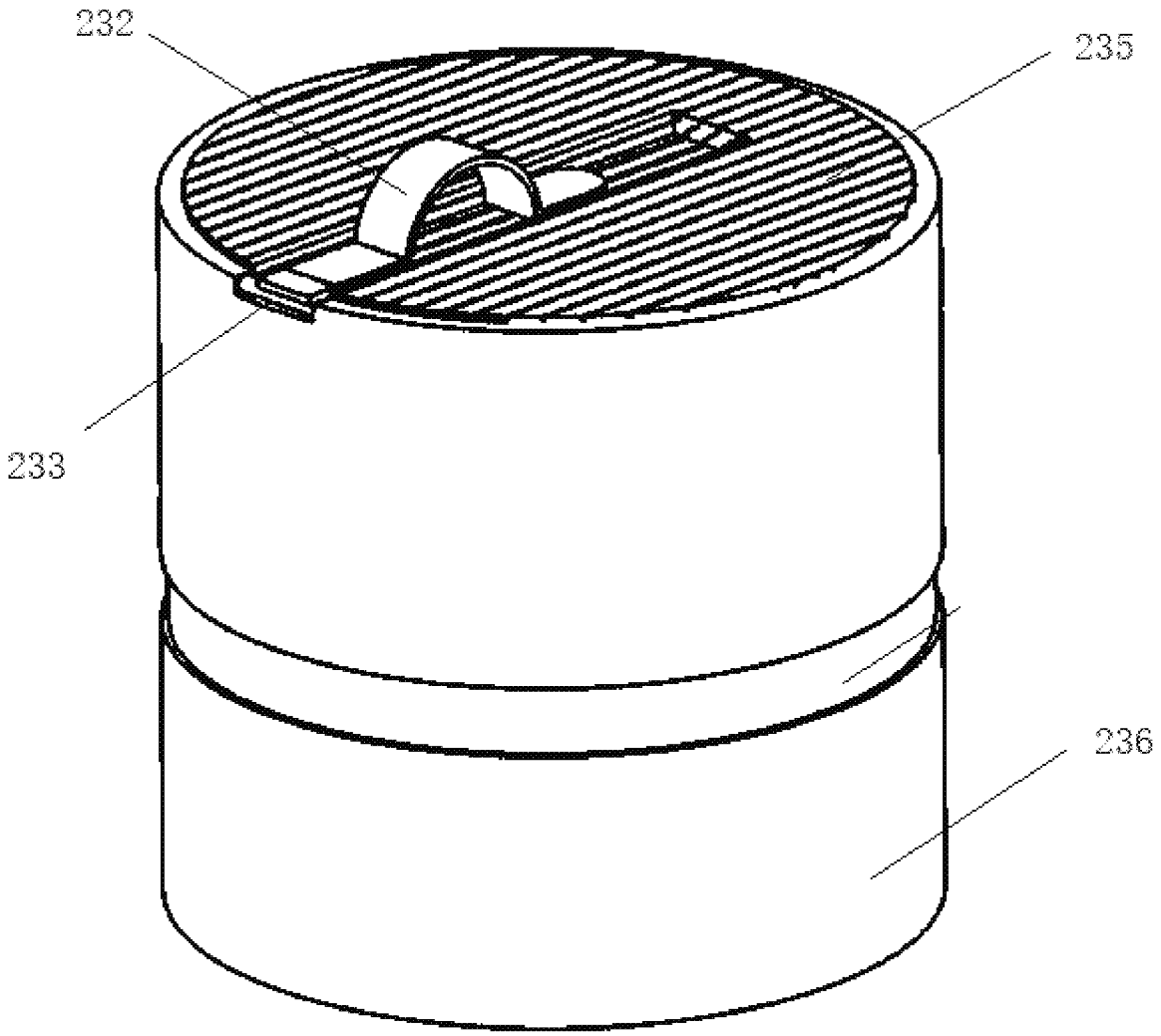
FIG. 12. The structural schematic diagram of the flap valve when it is turned down.
Figure 13:
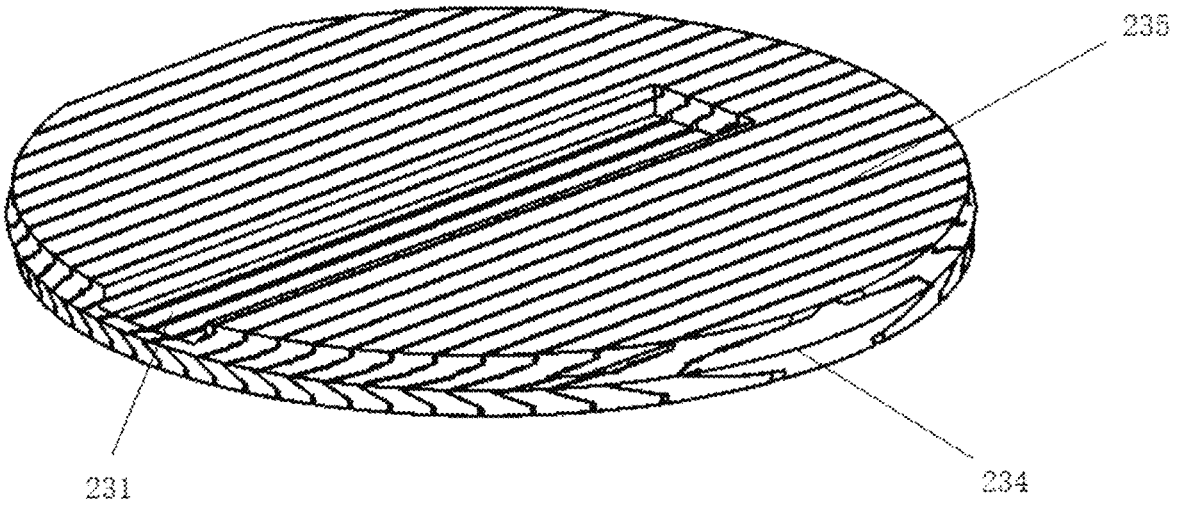
FIG. 13. The structural schematic diagram of the valve flap.

During operation, as the drilling of the drill bit 14, the rock core enters the inner core pipe 12 and passes through the middle of the core catcher 1. When the core passes through the hard claw 112, the claw 112 will be opened; when the drill is stopped and pulled upward, the claw 112 will move upward with the inner core pipe 12. Because the free end of the claw 112 retracts, at this time, it is difficult for the claw 112 to be stretched by the core. Because the core is unable to resist the great pulling force, and the free end of the claw 112 are clamped inward, the core is broken at the site of claw 112, and the broken core will continue to ascend with the claw 112 so as to remain in the inner core pipe 12. As shown in FIGS. 11, 12 and 13, the flap valve 23 includes a valve seat 236 and a valve flap 237. The valve flap 237 includes an elastic sealing ring 234, elastic connecting strips 232, sealings, and a plurality of locking strips 235 arranged in parallel. The elastic connecting strip 232 connects all the locking strips in series, and the elastic sealing ring 234 loops all the locking strips 235 together, to form an integral structure. The locking strip 235 is provided with a groove 231 adapted to the elastic sealing ring, and the elastic sealing ring 234 is installed in the groove 231. There is a sealing between two adjacent locking strips 235. One end of the valve flap 23 is movably connected to the upper end of the valve seat 236 through a limit hinge 233; the valve flap 237 is curved when it is not turned down, and the valve flap 237 is attached to the outer wall of the inner coring barrel 28; the valve flap 237 is flat when it is turned down and covers the upper end of the valve seat 236.

Figure 14:
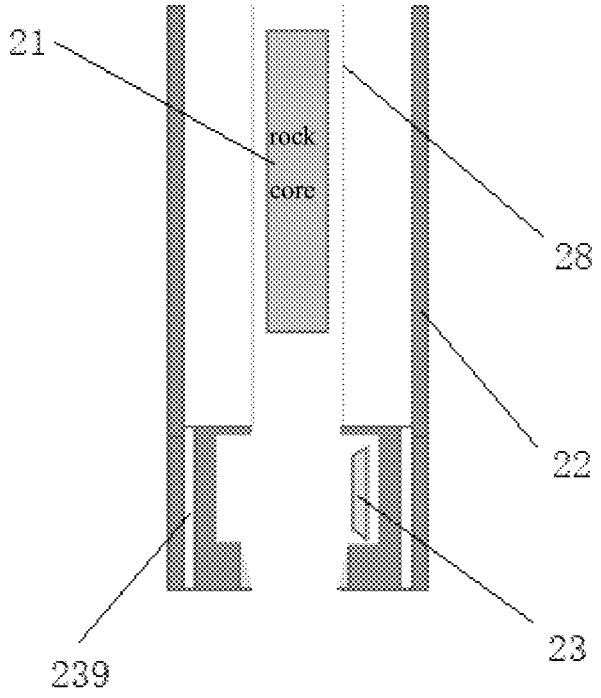
FIG. 14. The structural schematic diagram of the sealing cavity.

As shown in FIG. 14, the inner wall of the outer coring barrel 26 is provided with a sealing cavity 239, which is in communication with the inner coring barrel 28.

Figure 15:
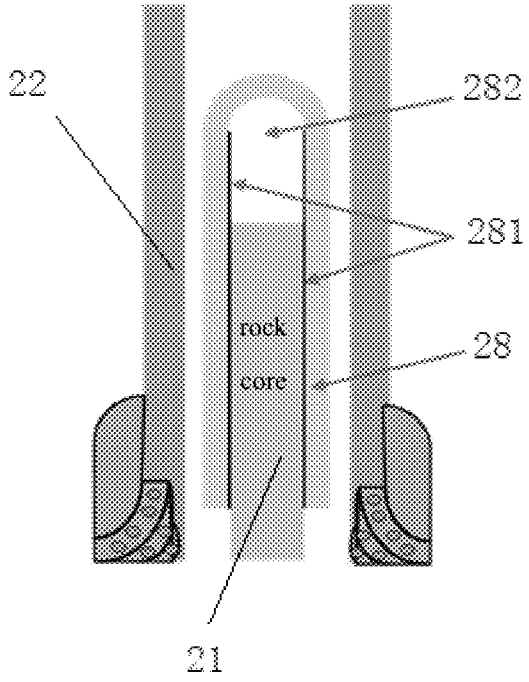
FIG. 15. A partial cross-sectional view of the inner core barrel.

As shown in FIG. 15, the inner coring barrel 28 is made of PVC material, and a graphene layer 281 is covered on the inner wall of the inner coring barrel 28. The upper part of the inner coring barrel 28 is filled with a drip film-forming agent 282.

Figure 16:
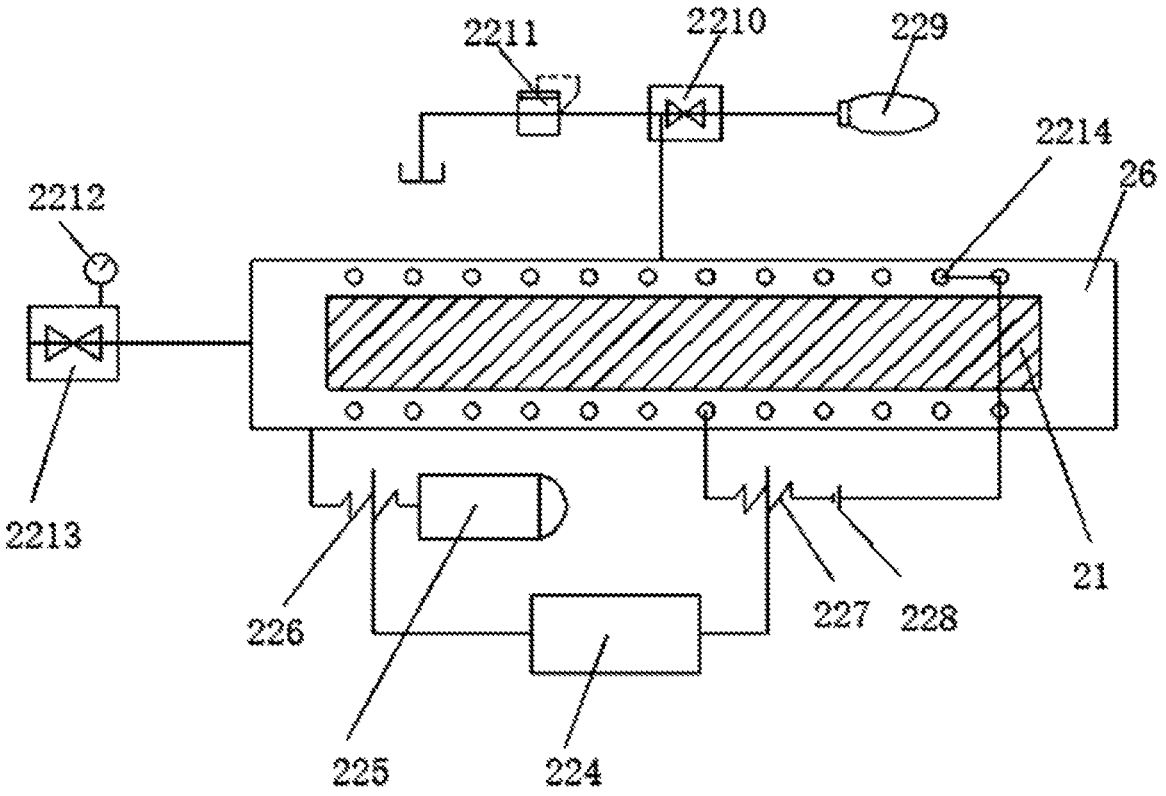
FIG. 16. The electrical schematic diagram of the present invention.

As shown in FIG. 16, the controlling unit comprises an electric heater 2214, a temperature sensor 25, and an electric control valve 226 arranged in the pipe. The temperature sensor 25 is connected to the processing unit 224. The electric heater 2214 is connected to the power supply 228 through a switch 227. The switch 227 and the electric control valve 226 are controlled by the processing unit 224. The electric heater is used to heat the inside of the outer coring barrel, and the temperature sensor is used to detect the temperature in the fidelity-retaining cabin. Electric heater 2214 is resistance wire, which is embedded in the inner wall of the outer coring barrel and coated with insulation layer. The power supply 228 of the control part is located on the outer coring barrel. The controlling unit also comprises a pressure sensor 27 and a three-way stop valve A 2210. The two ways of the three-way stop valve A 2210 are respectively connected with the energy accumulator 229 and the outer coring barrel 26, while the third way of the three-way stop valve A 2210 is connected with a pressure relief valve 2211. The stop valve A 2210 is an electrically controlled valve. The pressure sensor 27 and the three-way stop valve A 2210 are both connected to the processing unit 224. The pressure sensor 27 is used to detect the pressure in the fidelity-retaining cabin.

In the present invention, the device also includes a pressure gauge 2212, which is connected to the outer coring barrel by the three-way stop valve B 2213.

The temperature in the fidelity-retaining cabin is detected in real time by the temperature sensor, and compared with the in-situ temperature of the core previously measured. According to the difference between the two temperatures, the electric heater is controlled to heat or the electric control valve is controlled to open to inject liquid nitrogen into the fidelity-retaining cabin for cooling, so that the temperature in the constant fidelity-retaining cabin is the same as the in-situ temperature of the core. The pressure in the fidelity-retaining cabin is detected in real time by the pressure sensor, and compared with the in-situ pressure of the core previously measured. The on-off of the three-way stop valve A is controlled according to the difference between the two pressures, so that the pressure in the fidelity-retaining cabin is increased to keep the same as the in-situ pressure of the core. Since the ambient pressure of the fidelity-retaining cabin during the lifting process is gradually reduced, and the in-situ pressure of the core is greater than the ambient pressure of the fidelity-retaining cabin during the lifting process, thus pressurization measures can be adopted.

Certainly, there still may be various other examples of the present invention. Without department from the spirit and the essence of the present invention, those skilled in the art can make various corresponding changes and modifications according to the present invention, which should be within the scope of the claims of the present invention.

The invention claimed is:

1. A fidelity-retaining coring device, comprising:

a rock core drilling tool, a rock core sample storage barrel, and a rock core sample fidelity-retaining cabin, wherein the rock core drilling tool comprises a coring drilling tool, a core catcher, and an inner core pipe, wherein the coring drilling tool comprises an outer core pipe and a hollow drill bit, and the drill bit is connected to a lower end of the outer core pipe, wherein the core catcher comprises an annular base and a plurality of claws, the annular base being coaxially mounted on an inner wall of the lower end of the inner core pipe, and the plurality of claws being uniformly arranged on the annular base, a lower end of each of the plurality of claws is connected with the annular base, and an upper end of each of the plurality of claws is closed inward, wherein a lower end of the inner core pipe extends to a bottom of the outer core pipe, and the inner core pipe is in clearance fit with the outer core pipe;

wherein the core sample storage barrel comprises a rock core barrel, a drilling machine outer cylinder, a flap valve, and a trigger mechanism, wherein the flap valve comprises a valve seat and a sealing flap, the valve seat is coaxially mounted on an inner wall of the drilling machine outer cylinder, and one end of the sealing flap is movably connected to an outer sidewall of the upper end of the valve seat, and a top of the valve seat is provided with a valve port sealing surface matched with the sealing flap, wherein the rock core sample fidelity-retaining cabin comprises an inner coring barrel, an outer coring barrel, and an energy accumulator, wherein the outer coring barrel is sleeved on the inner coring barrel, an upper end of the inner coring barrel is in communication with a liquid nitrogen storage tank located in the outer coring barrel, wherein the energy accumulator is in communication with the outer coring barrel, and the outer coring barrel is provided with a flap valve.

2. The fidelity-retaining coring device according to claim 1, wherein the rock core sample fidelity-retaining cabin further comprises an electric heater, a temperature sensor, an electric control valve arranged between the inner coring barrel and the liquid nitrogen storage tank, a pressure sensor, and a three-way stop valve arranged between the energy accumulator and the outer coring barrel, wherein a first way and a second way of the three-way stop valve are respectively connected with the energy accumulator and the outer coring barrel, while a third way of the three-way stop valve is connected with a pressure relief valve, and wherein the electric heater is configured to heat the outer coring barrel, the temperature sensor is configured to detect a temperature in the fidelity-retaining cabin, and the pressure sensor is configured to detect a pressure in the fidelity-retaining cabin.

3. The fidelity-retaining coring device according to claim 2, wherein the electric heater is a resistance wires which is embedded in the inner wall of the outer coring barrel.

4. The fidelity-retaining coring device for a rock sample according to claim 1, wherein the drill bit comprises an inner drill bit and an outer drill bit, the inner drill bit being installed in the outer drill bit, wherein three first-stage blades are arranged at equal intervals in a circumferential direction on a lower end of the inner drill bit, and three second-stage blades are arranged at equal intervals in a circumferential direction on an outer sidewall of the outer drill bit, and both the three first-stage blades and the three second-stage blades are provided with coolant circuit holes.

5. The fidelity-retaining coring device according to claim 1, wherein the outer core pipe and the outer wall of the drill bit are both provided with a spiral groove, and the spiral groove on the drill bit is continuous with the spiral groove on an outer core tube.

6. The fidelity-retaining coring device according to claim 1, wherein each of the plurality of claws comprises a vertical arm and a tilt arm which are integrally manufactured, a lower end of the vertical arm is connected with the annular base, an upper end of the vertical arm is connected with a lower end of the tilt arm, the upper end of the tilt arm is a free end, and the tilt arm is configured to tilt inward from bottom to top.

7. The fidelity-retaining coring device according to claim 1, wherein the sealing valve flap includes an elastic sealing ring, an elastic connecting strips, a plurality of sealings, and a plurality of locking strips arranged in parallel, wherein the elastic connecting strip connects the plurality of locking strips in series, and the elastic sealing ring loops the plurality of locking strips together to form an integral structure, each locking strip is provided with a groove adapted to receive the elastic sealing ring, two adjacent locking strips have one of the plurality of sealings arranged therebetween, one end of the valve flap is movably connected to the upper end of the valve seat through a limit hinge, and the valve flap is attached to the outer wall of the inner coring barrel.

8. The fidelity-retaining coring device according to claim 1, wherein the inner wall of the outer coring barrel is provided with a sealing cavity, and a flap plate is located in the sealing cavity, and the sealing cavity is in communication with the inner coring barrel.

9. The fidelity-retaining coring device according to claim 1, further comprising a graphene layer coated on the inner wall of the inner coring barrel.

10. The fidelity-retaining coring device according to claim 1, wherein an upper part of the inner coring barrel is filled with a drip film-forming agent.

* * * * *